US010622733B2

(12) United States Patent
Sakakura et al.

(10) Patent No.: US 10,622,733 B2
(45) Date of Patent: Apr. 14, 2020

(54) RESIN MOLDED PRODUCT

(71) Applicant: Sumitomo Wiring Systems, Ltd., Yokkaichi, Mie (JP)

(72) Inventors: Kouji Sakakura, Mie (JP); Yutaka Kobayashi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/078,782

(22) PCT Filed: Feb. 7, 2017

(86) PCT No.: PCT/JP2017/004354
§ 371 (c)(1),
(2) Date: Aug. 22, 2018

(87) PCT Pub. No.: WO2017/150092
PCT Pub. Date: Sep. 8, 2017

(65) Prior Publication Data

US 2019/0051997 A1 Feb. 14, 2019

(30) Foreign Application Priority Data

Feb. 29, 2016 (JP) ..... 2016-036779

(51) Int. Cl.
*H01R 13/405* (2006.01)
*H01R 43/24* (2006.01)
(Continued)

(52) U.S. Cl.
CPC ..... *H01R 9/16* (2013.01); *H01R 13/405* (2013.01); *H01R 4/30* (2013.01); *H01R 9/2491* (2013.01)

(58) Field of Classification Search
CPC ..... H01R 9/16; H01R 9/2491; H01R 9/2495; H01R 9/2408; H01R 9/223; H01R 13/405; H01R 4/30; H01R 13/504; H01R 43/24
(Continued)

(56) References Cited

U.S. PATENT DOCUMENTS 8,152,574 B2 * 4/2012 Matsuoka ..... H01R 4/302 439/587
8,317,544 B2 * 11/2012 Matsuoka ..... H01R 4/64 439/607.55
(Continued)

FOREIGN PATENT DOCUMENTS

JP 2001-33237 11/2001
JP 2007-33164 2/2007
(Continued)

OTHER PUBLICATIONS

International Search Report dated May 16, 2017.

*Primary Examiner* — Edwin A. Leon
*Assistant Examiner* — Milagros Jeancharles
(74) *Attorney, Agent, or Firm* — Gerald E. Hespos; Michael J. Porco; Matthew T. Hespos

(57) ABSTRACT

A resin molded product has a terminal body (10) in which plate-like terminals (20) and a housing (40) made of synthetic resin are integrally fixed. Each terminal (20) includes a bend (22), terminal bodies (21) and wire-side connecting portions (23) continuous with both ends of the terminals (20). Molded portions (62) embed parts of the terminal bodies (21) and the wire-side connecting portions (23) together with inner curved surfaces (30) of the bends (22). Flat side surfaces (25) of the terminal bodies (21) and flat side surfaces (27) of the wire-side connecting portions (23) are exposed from and adjacent to the molded portions (62) on both sides of the terminal bodies (21) and both sides of
(Continued)

the wire-side connecting portions (23), and flat surfaces (32) are exposed from the molded portions (62) on both side surfaces (22A) of the bend (22).

2 Claims, 18 Drawing Sheets

(51) Int. Cl.
*H01R 9/16* (2006.01)
*H01R 4/30* (2006.01)
*H01R 9/24* (2006.01)

(58) Field of Classification Search
USPC ..... 439/604, 606, 626, 709, 736, 801
See application file for complete search history.

(56) References Cited

U.S. PATENT DOCUMENTS

| | | | | |
|---|---|---|---|---|
| 8,545,265 | B2 * | 10/2013 | Sakamoto | B29C 45/14 439/606 |
| 8,556,660 | B2 * | 10/2013 | Matsuoka | B29C 45/1671 439/606 |
| 9,407,027 | B2 * | 8/2016 | Yoshida | H01R 13/405 |
| 2011/0187213 | A1 * | 8/2011 | Kitagawa | H02K 5/225 310/71 |
| 2012/0238143 | A1 | 9/2012 | Matsuoka et al. | |
| 2015/0061105 | A1 | 3/2015 | Oose | |

FOREIGN PATENT DOCUMENTS

| | | |
|---|---|---|
| JP | 2012-195067 | 10/2012 |
| JP | 2014-232688 | 12/2014 |
| JP | 2015-53301 | 3/2015 |

* cited by examiner

RESIN MOLDED PRODUCT

BACKGROUND

Field of the Invention

This specification relates to a resin molded product.

Related Art

Japanese Unexamined Patent Publication No. 2012-195067 discloses a terminal block formed to integrally fix an L-shaped conductive plate including a bent portion bent into an L shape and a connector housing made of synthetic resin.

The conductive plate initially is formed into the L-shape by stamping and bending a metal plate material by press working. The L-shaped conductive plate then is set in a mold and molding resin is poured into the mold to form a primary molded product. The connector housing then is molded by performing secondary molding using this primary molded product as a core.

If the conductive plate is made thicker, side parts of the bend are distorted, causing outer peripheral parts on side surfaces of the bend to thin as the conductive plate is bent and causing the formation of excess metal parts bulging out on inner peripheral parts on the side surfaces of the bend.

Accordingly, if it is attempted to mold a connector housing by cutting off resin between side edge parts of the bend and a mold for molding the connector housing, clearances are formed between the side edge parts of the bend and the mold for molding the connector housing due to the excess metal parts. Thus, resin leakage occurs at the bend.

Thus, it has been and is being studied to cut off molding resin by shaping the side edges of the bent portion to be flat and bringing the side edge parts of the bend and the mold into surface contact. However, in the case of shaping the entire side edges or outer peripheral edges of the bend to be flat on the basis of the outer peripheral edge parts, a width of the bend varies. Thus, in molding the connector housing, the arrangement of the mold needs to be adjusted for each conductive plate and the efficiency of a connector housing molding operation is reduced.

An object of the invention is to improve efficiency of a molding operation while preventing resin leakage.

SUMMARY

The invention is directed to a resin molded product in which a plate-like metal member and a resin portion made of synthetic resin are fixed integrally. The resin molded product includes a bend obtained by bending the metal member so that two flat plates extend continuously from both ends of the bend in the metal member. A molded portion is provided to embed parts of the flat plates together with an inner surface of the bend. Both side edges extending along an extending direction of the flat plates are exposed from the molded portion, and inner peripheral edges of both side edges extending along a bending direction in the bend are continuous and flush with the flat surfaces of the flat plates and are disposed adjacent to the molded portion to be exposed from the molded portion.

If it is attempted to cut off molding resin by bringing a mold for forming the resin portion into contact with side parts of the bend that is distorted by bending a thick metal plate material, the resin tends to leak from distorted parts. However, according to aspects of the invention described above, the molding resin can be cut off by bringing the mold into contact with the flat surfaces of the flat plates and the flat surfaces provided to be flush with the flat side surfaces on the inner peripheral edges of the bend. Thus, resin leakage at side edges of the bend can be prevented.

Further, the flat surfaces provided on the inner peripheral edges of the side edges of the bend and the flat side surfaces of the flat plates are flush with each other. Additionally, the flat plates and the bend have the same width. Thus, the metal member can be set in the mold on the basis of the width of the flat plates having high dimensional stability. Thus, work efficiency in an assembling operation of the resin molded product is high, for example, as compared to the case where flat surfaces are provided on the entire side edges or outer peripheral edges of the bend on the basis of the outer peripheral edges of the bend and the arrangement of the mold is adjusted for each terminal.

The flat plates may constitute a connecting portion connectable to a mating conductor. If the connecting portion is continuous with the bend, there is a tendency that the molding resin adheres to a connection surface of the connecting portion and connection reliability between the mating conductor and the connecting portion is reduced if resin leakage occurs at the bend. However, according to this configuration, the bend is worked to be flattened, thereby forming the flat surfaces that are continuous and flush with the flat side surfaces of the flat plate, and the resin can be cut off by the flat side surfaces of the flat plates, the flat side surfaces of the bend and the mold. This is very effective to prevent resin leakage to the connecting portion.

The invention improves work efficiency during a molding operation and prevents resin leakage.

DETAILED DESCRIPTION

An embodiment is described with reference to FIGS. 1 to 18.

A terminal block (an example of a "resin molded product") 10 to be mounted on an unillustrated case of a device installed in a vehicle is illustrated in this embodiment. The terminal block 10 is for joining unillustrated device-side terminals disposed in the case and unillustrated mating terminals (an example of a "mating conductor") provided on an end of a wiring harness. Note that, in the following description, a lateral direction is based on a lateral direction in FIGS. 2 and 10 and a vertical direction is based on a vertical direction in FIGS. 2 and 10. Further, a front-rear direction is based on a lateral direction in FIGS. 5, 11 and 17, wherein a shown left side is referred to as a front and a shown right is referred to as a rear.

As shown in FIGS. 1 to 7, the terminal block 10 includes three laterally juxtaposed terminals (an example of a "metal member") 20, and a housing (an example of a "resin portion") 40 made of synthetic resin is fixed integrally to the three terminals 20.

Figure 8:
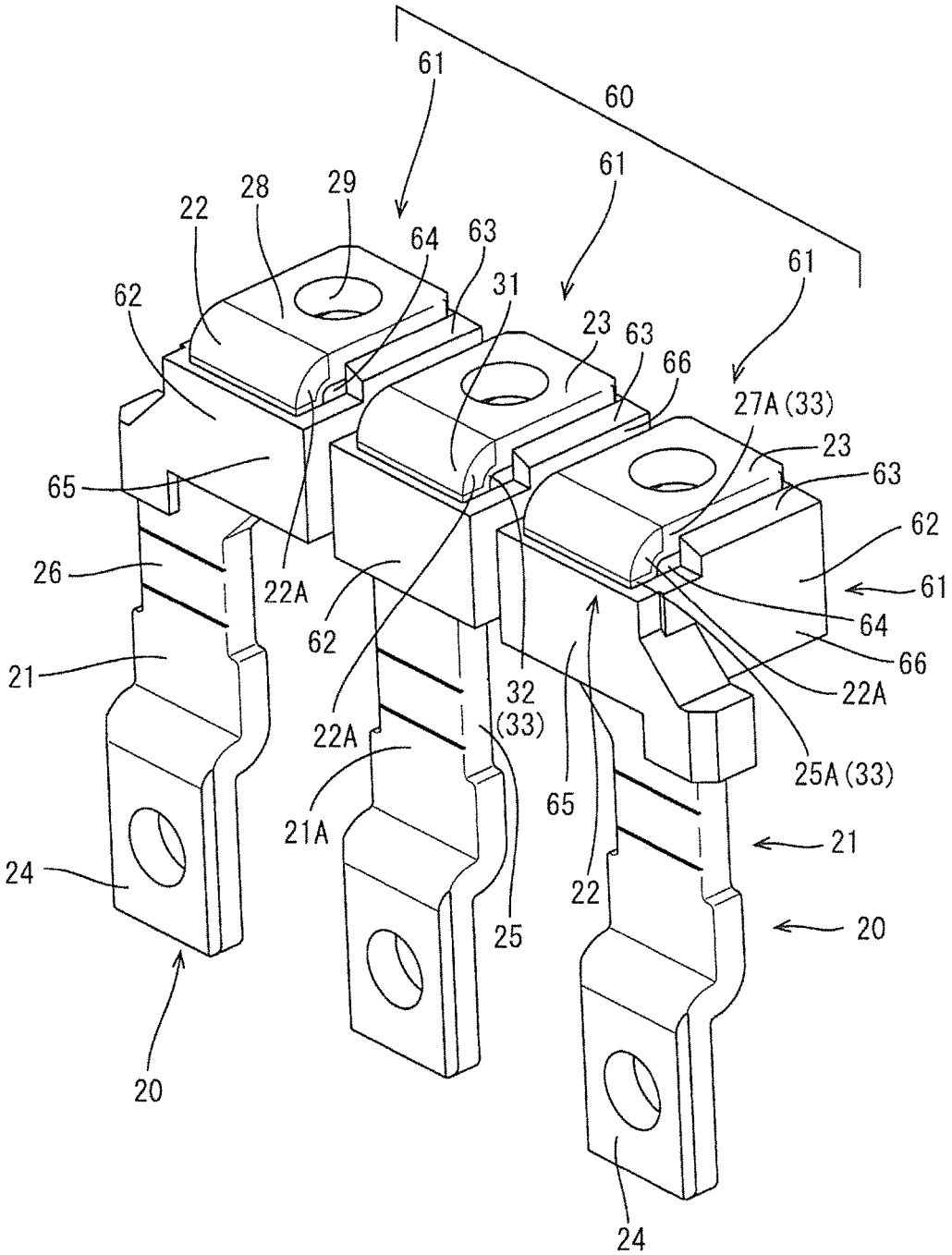
FIG. 8 is a perspective view of a primary molded product group.
Figure 9:
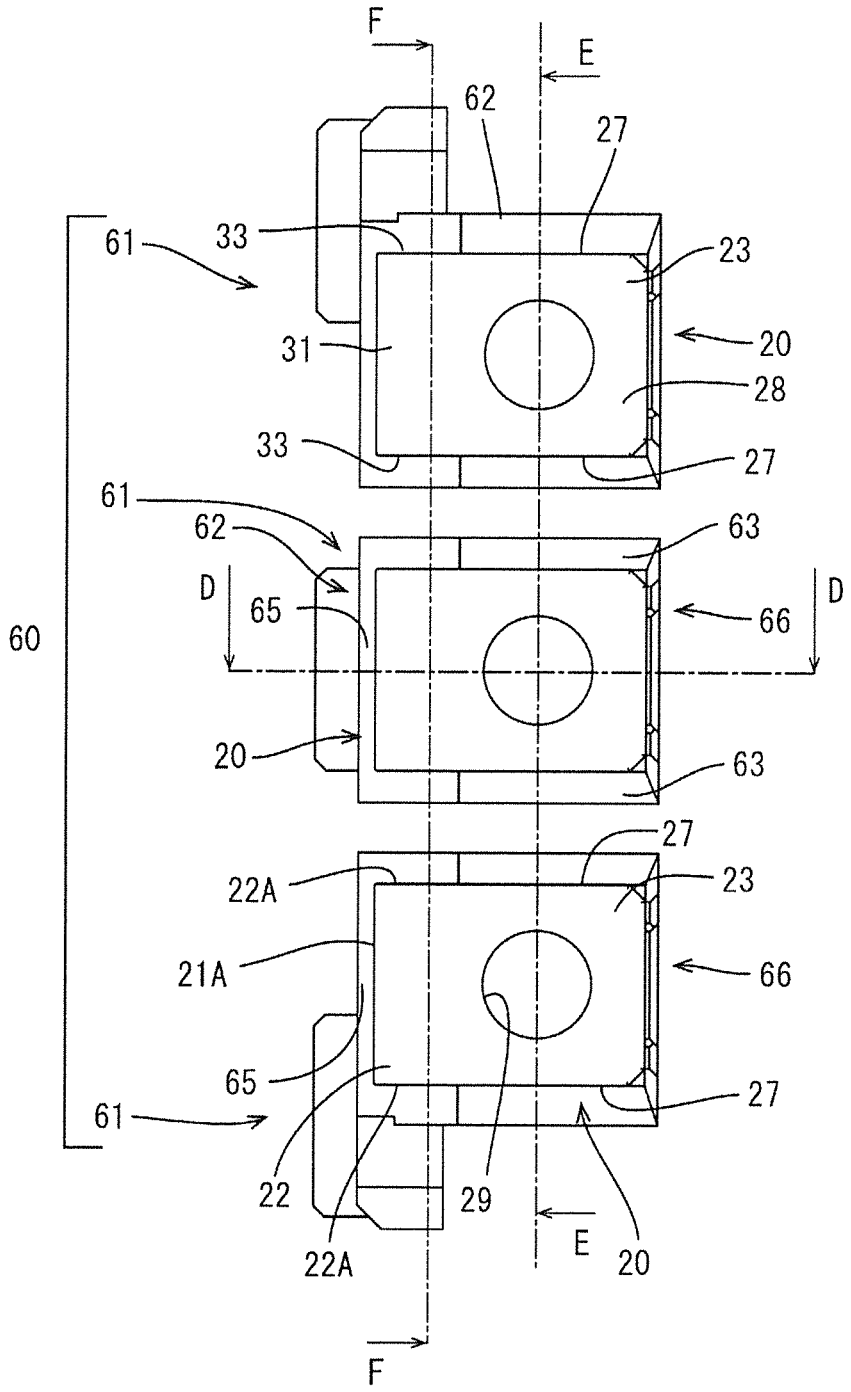
FIG. 9 is a plan view of the primary molded product group.
Figure 15:
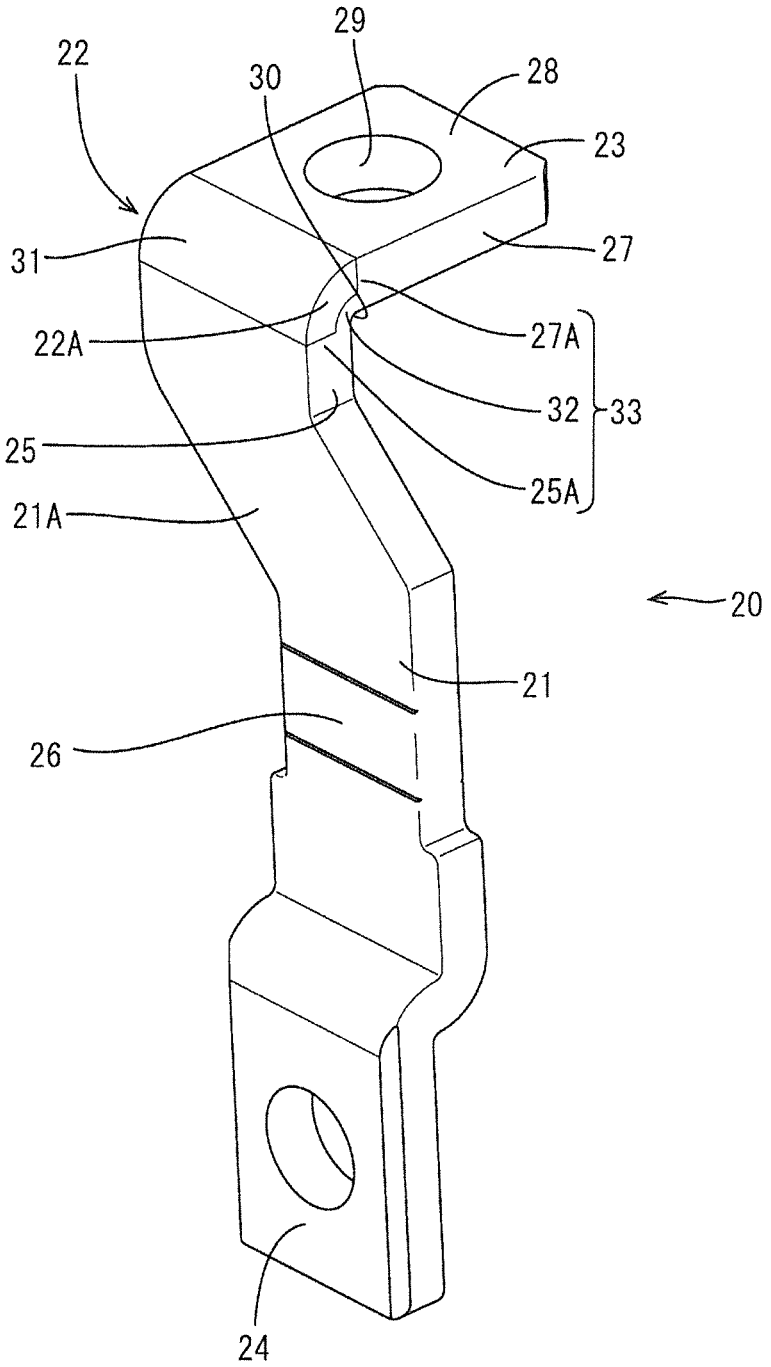
FIG. 15 is a perspective view of a terminal.
Figure 16:
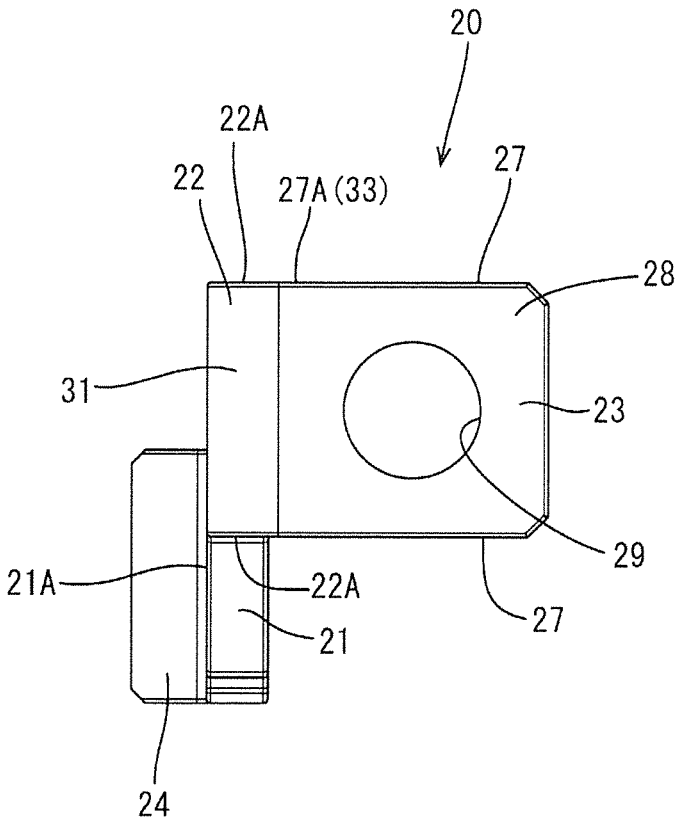
FIG. 16 is a plan view of the terminal.
Figure 17:
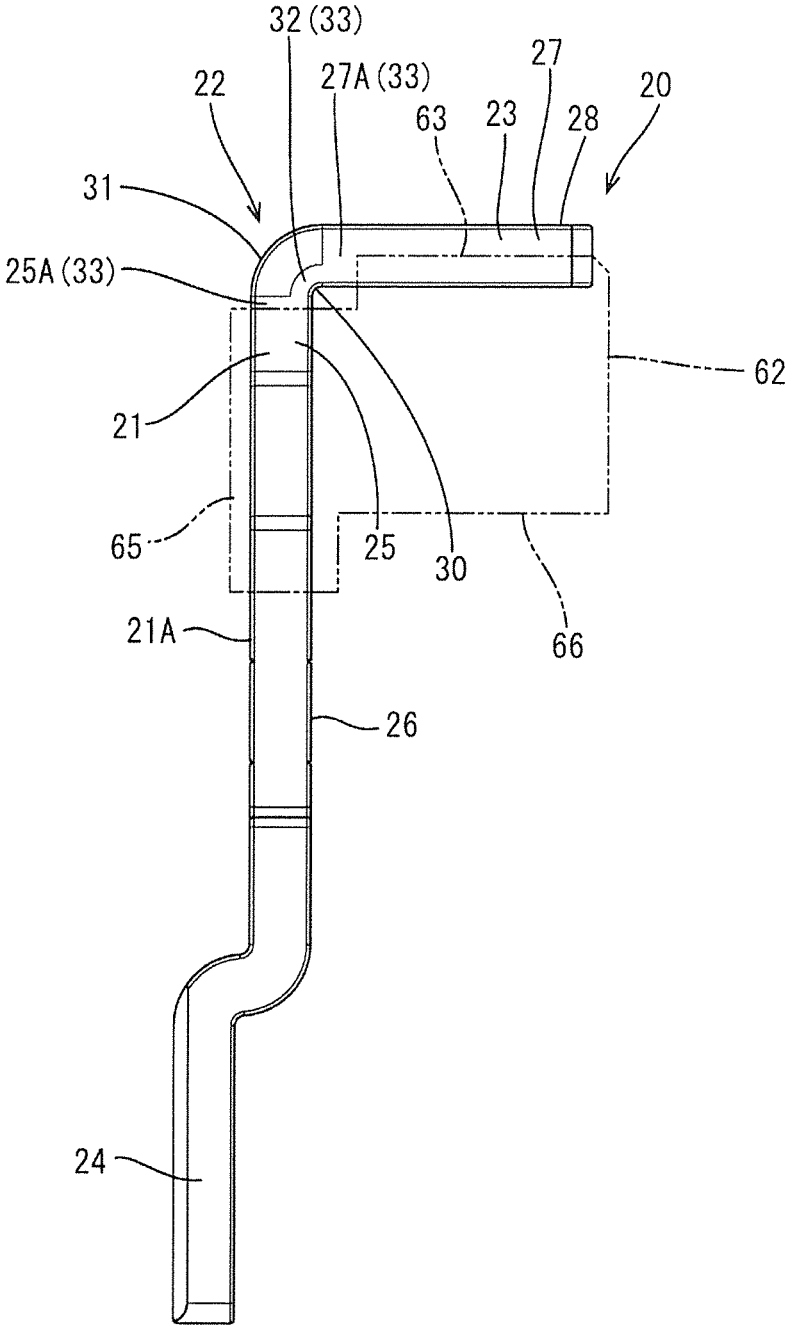
FIG. 17 is a side view of the terminal.

As shown in FIGS. 15 to 17, each terminal 20 is formed into a vertically long strip by stamping and bending a thick metal plate material that is excellent in conductivity. The terminal 20 includes a flat plate-shaped terminal body (an example of a "flat plate") 21 extending in the vertical direction. A bend 22 is provided on an upper end of the terminal body 21, and a wire-side connecting portion (an example of the "flat plate" and a "connecting portion") 23 extends rearward from the bend 22. A flat plate-shaped device-side connecting portion 24 is provided on a lower part of the terminal body 21. Note that, out of the three terminals 20, left and right terminals 20 have a common structure except that upper sides of the terminal bodies 21 are bent in opposite directions along the lateral direction. Thus, the terminal 20 on the right side in FIGS. 1 and 8 is described as a representative.

Figure 1:
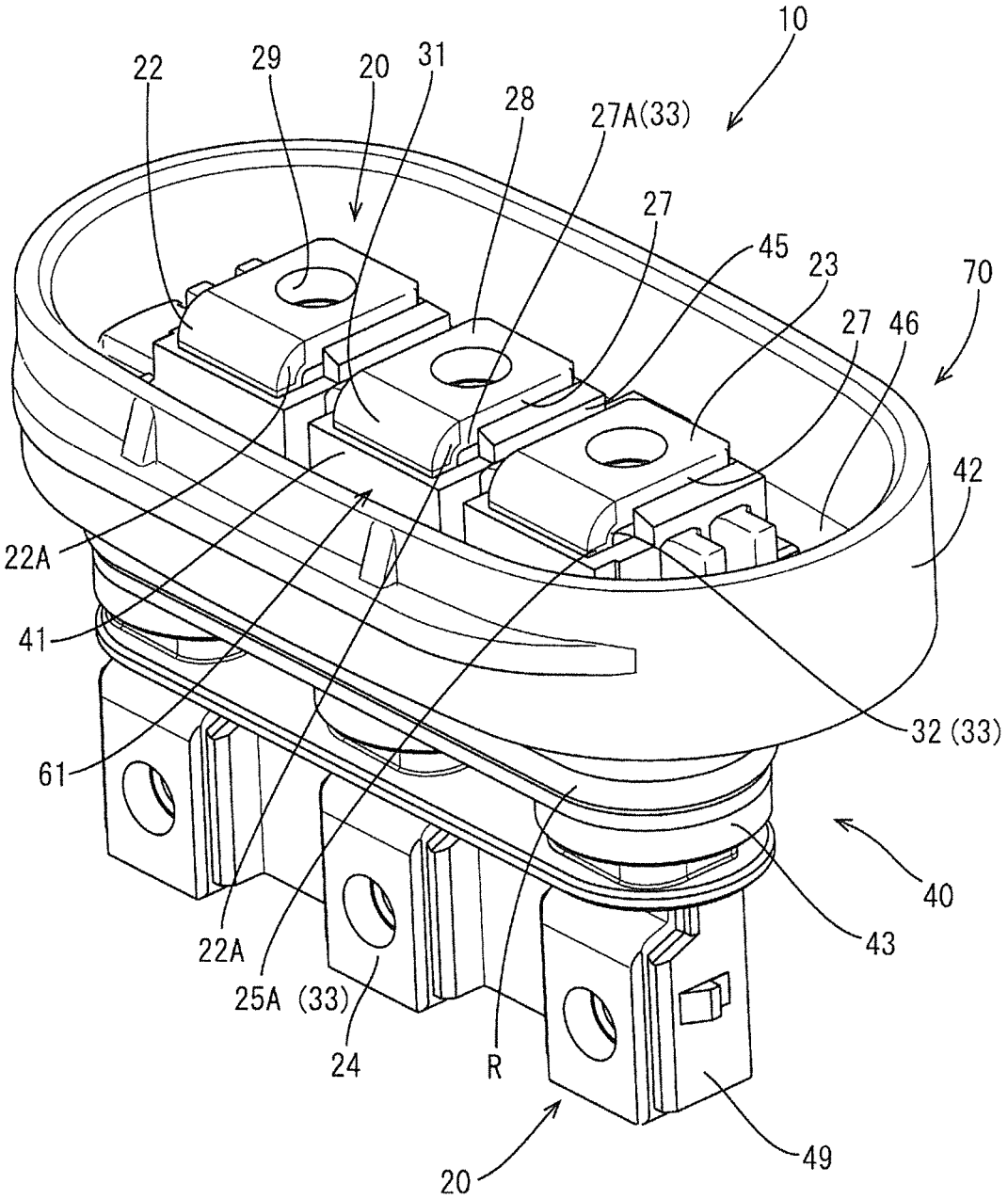
FIG. 1 is a perspective view of a terminal block.
Figure 2:
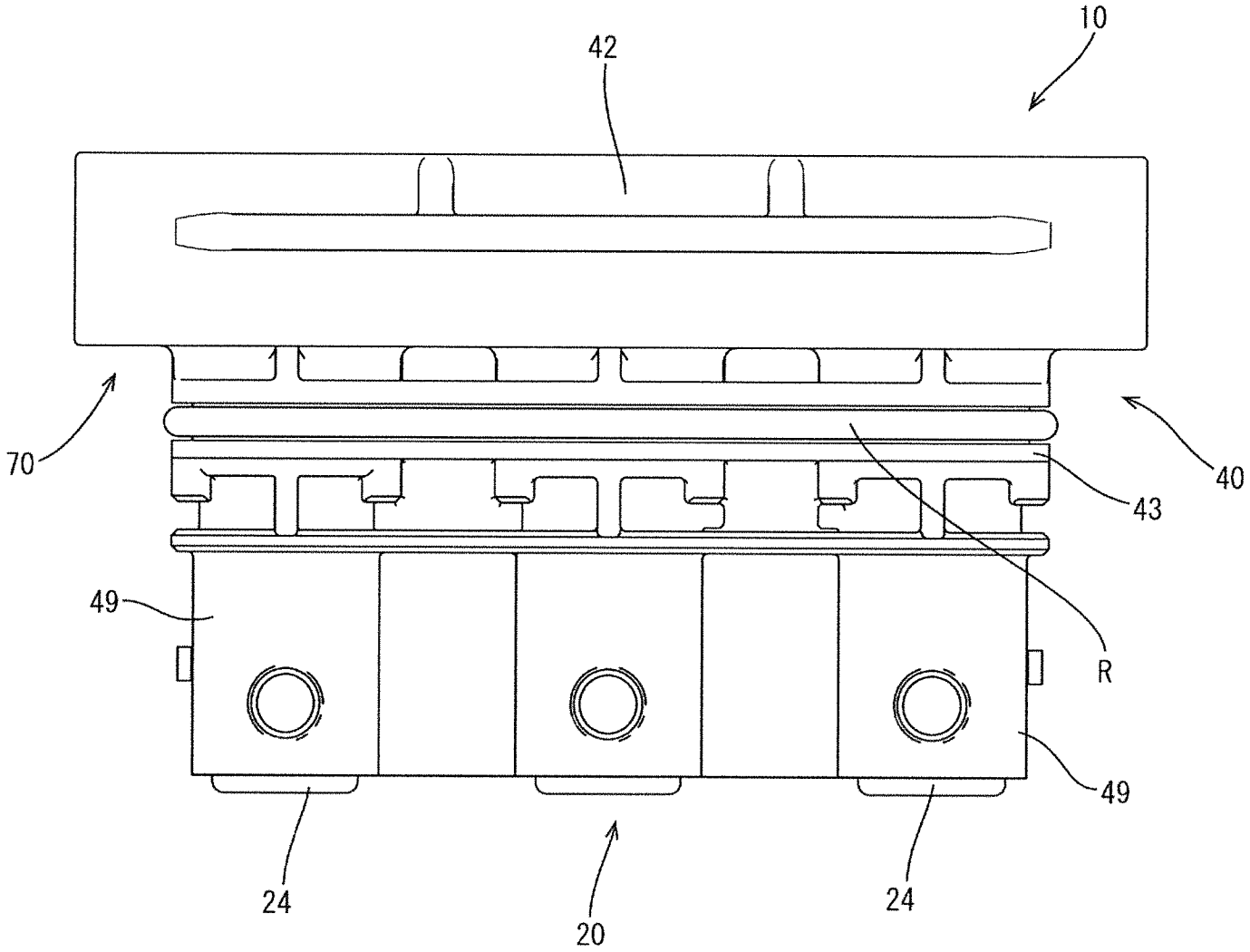
FIG. 2 is a back view of the terminal block.
Figure 5:
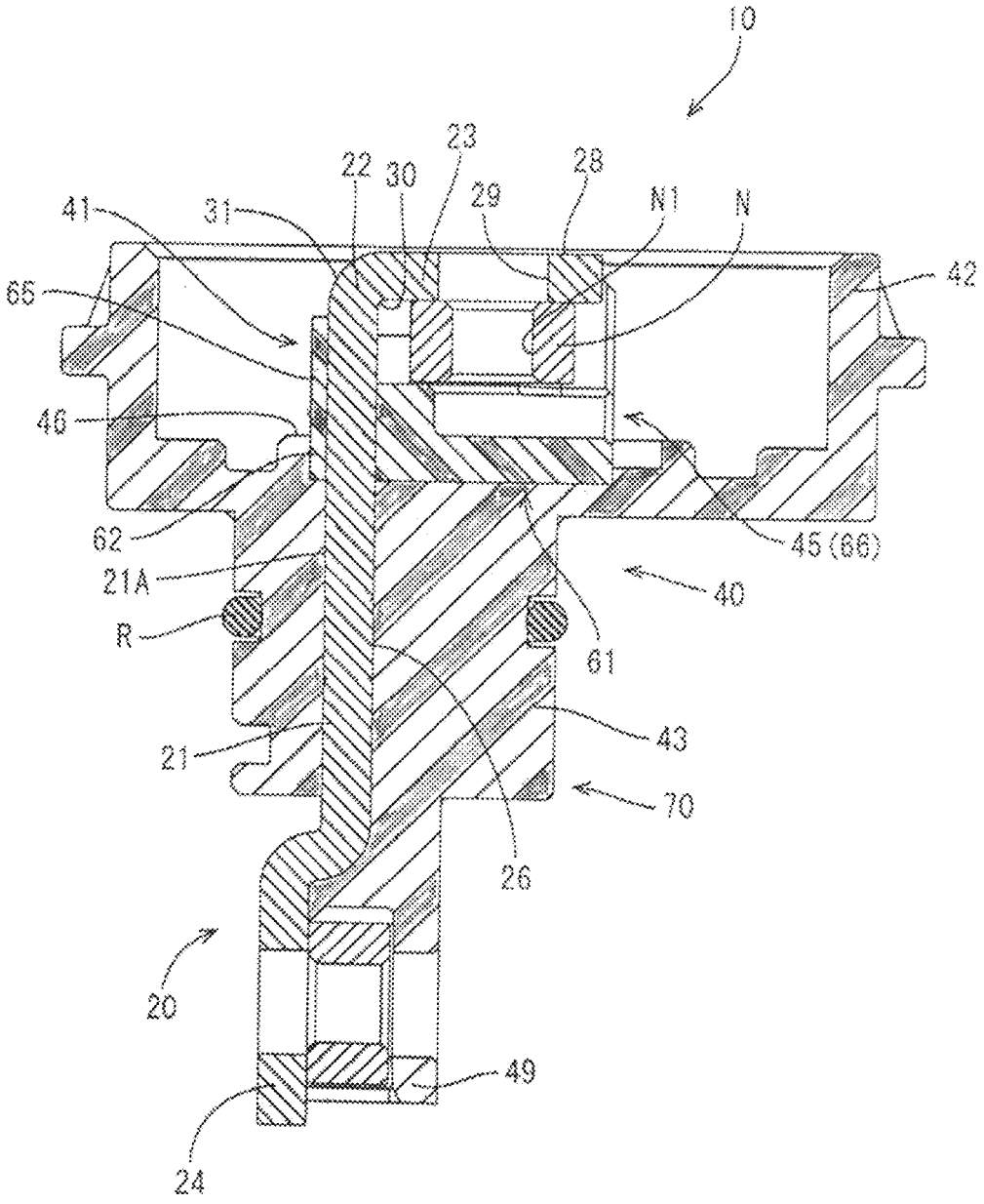
FIG. 5 is a section along A-A of FIG. 3.
Figure 6:
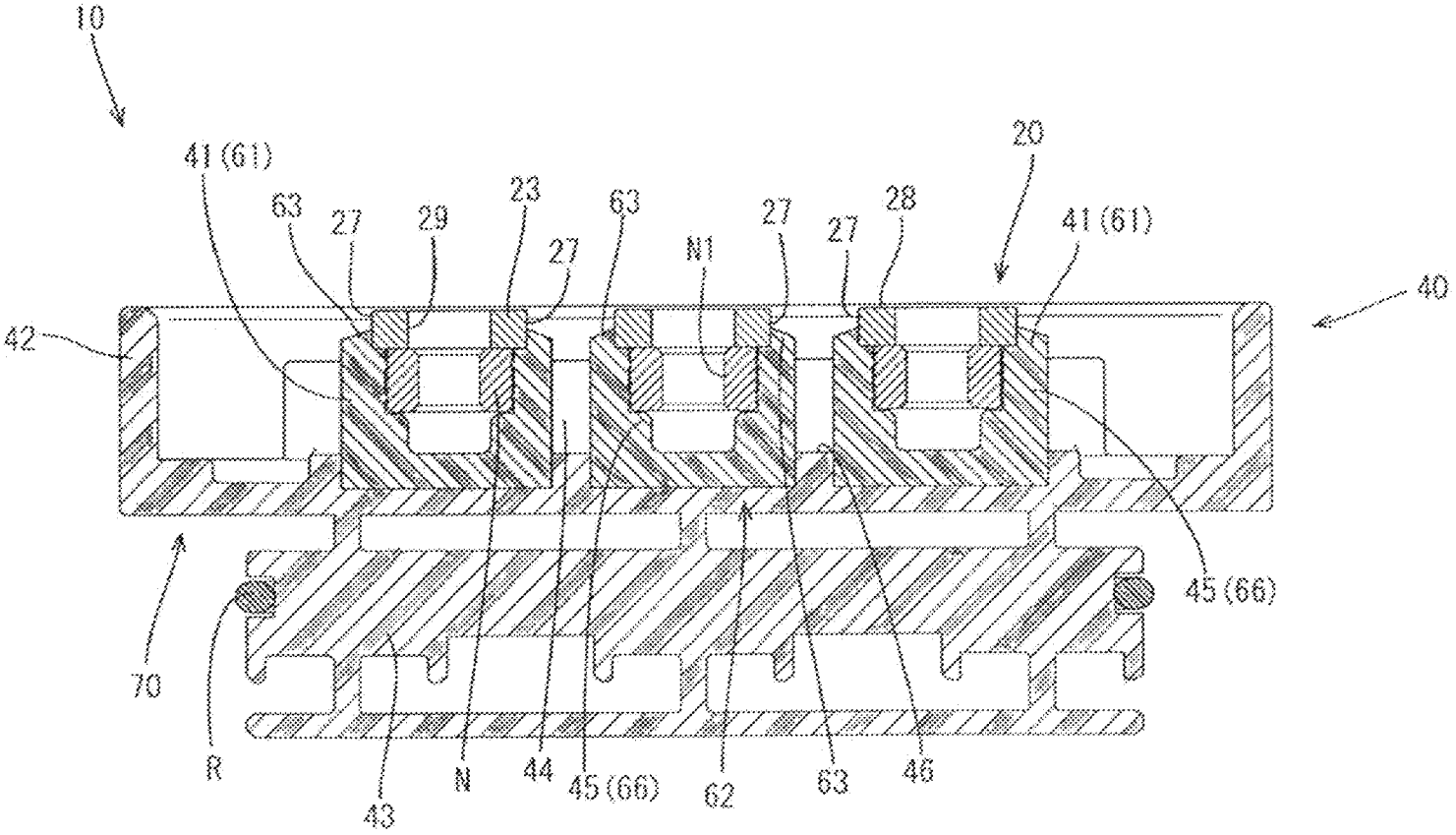
FIG. 6 is a section along B-B of FIG. 3.
Figure 7:
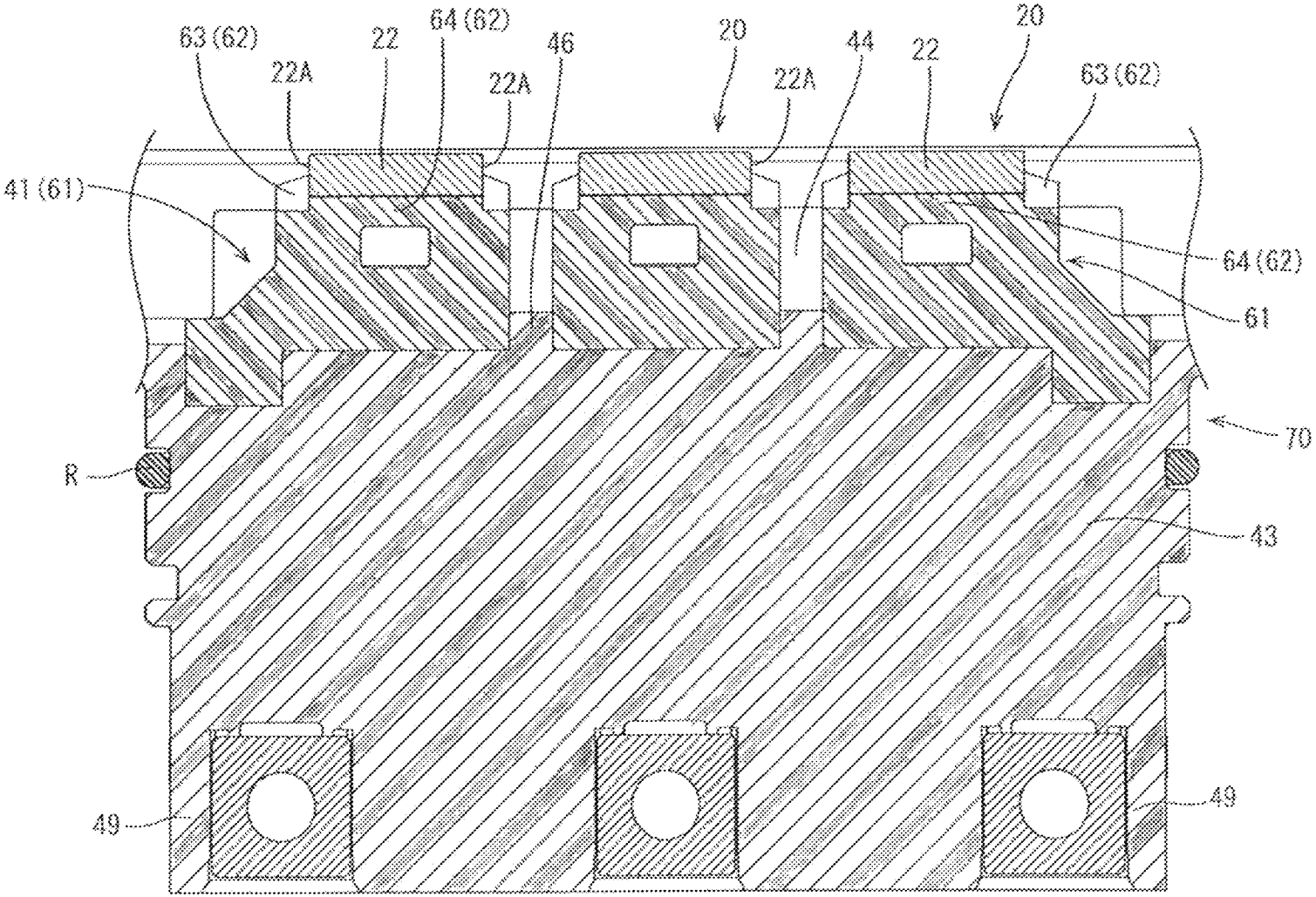
FIG. 7 is a section along C-C of FIG. 3.
Figure 10:
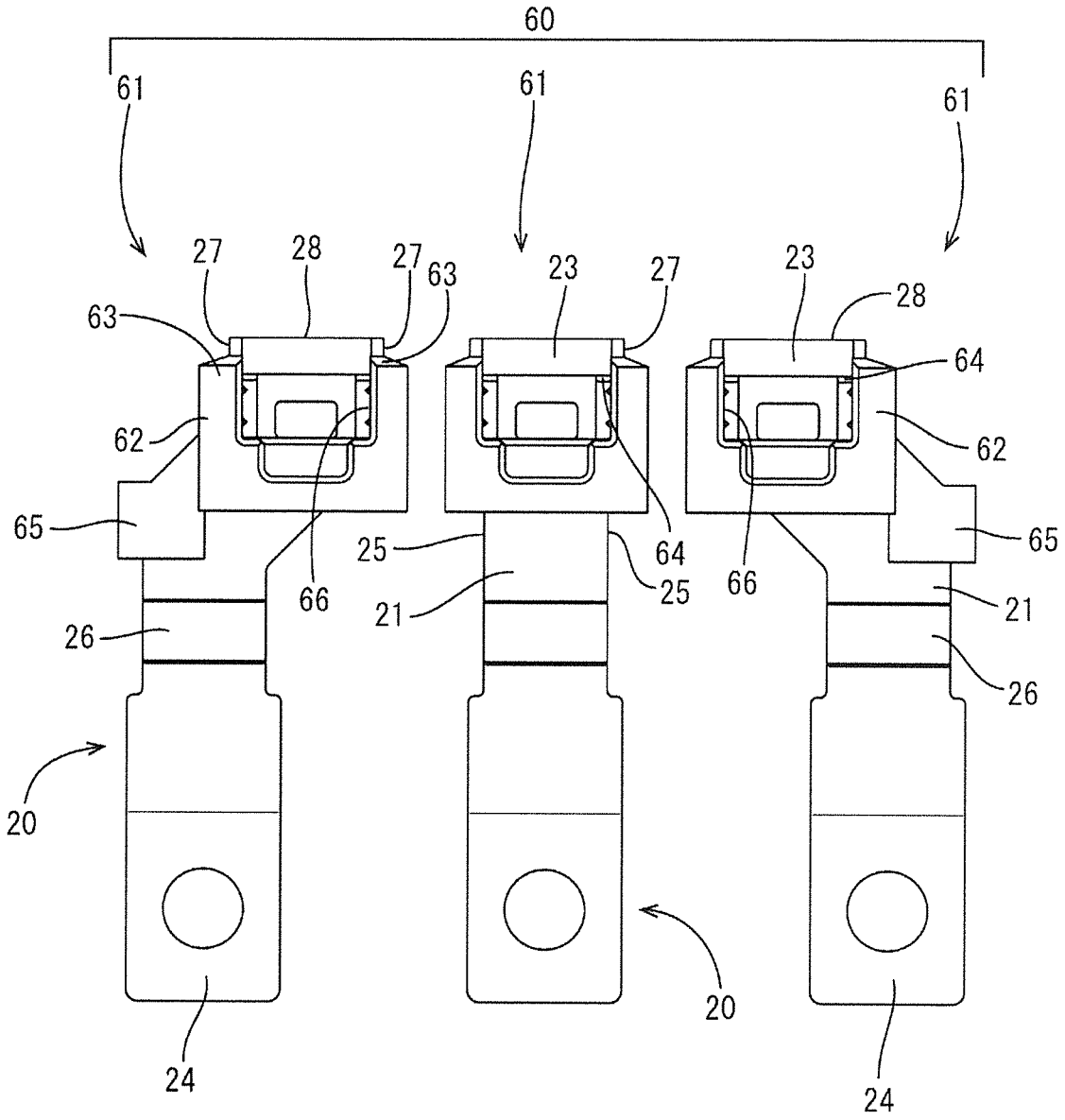
FIG. 10 is a back view of the primary molded product group.

As shown in FIGS. 1 and 5, the terminal body 21 is embedded entirely in the housing 40 except at upper and lower parts thereof. The upper part of the terminal body 21 has opposite flat side surfaces 25 extending straight in the vertical direction, as shown in FIGS. 15 and 17. As shown in FIGS. 8, 10 and 15, a sealant adhering portion 26 to which sealant (not shown) is adhered is provided in a substantially vertically central part of the terminal body 21. An interface between the sealant adhering portion 26 and the housing 40 is waterproofed by adhering the sealant to the sealant adhering portion 26 and embedding the sealant adhering portion 26 in the housing 40.

Figure 11:
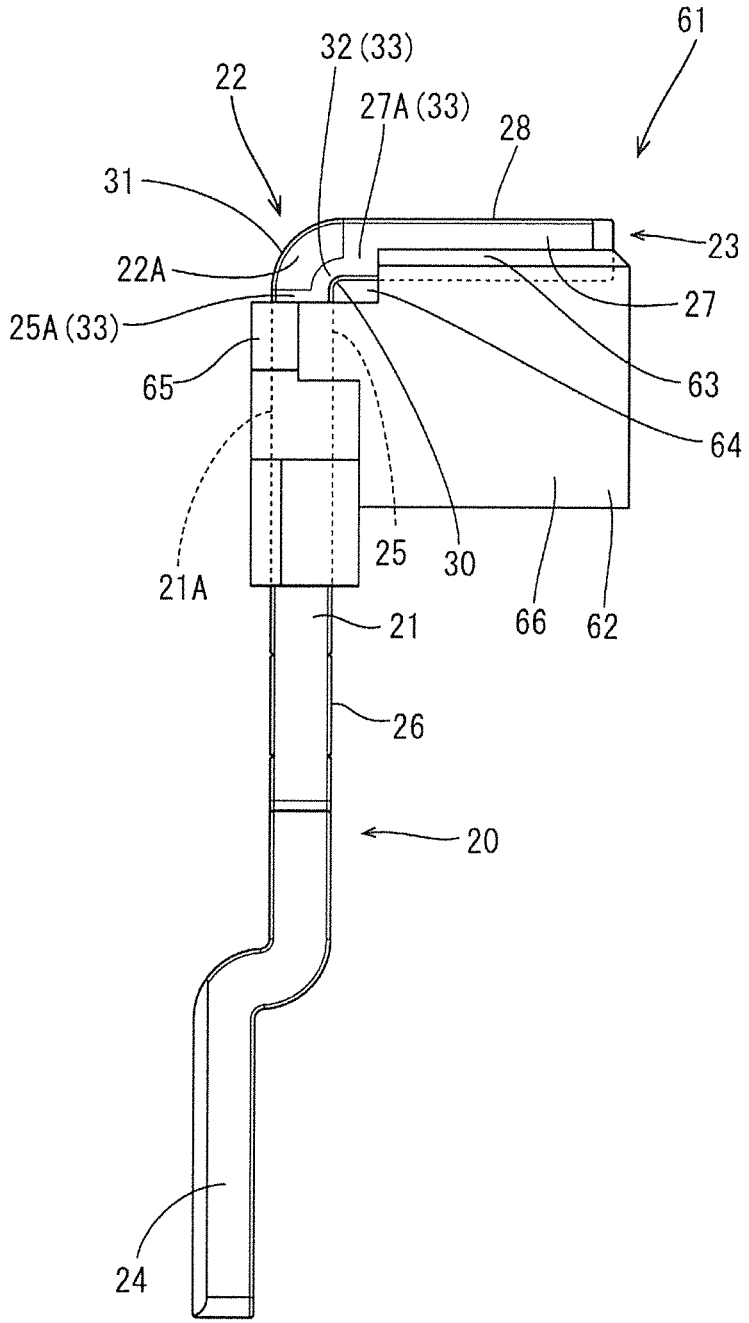
FIG. 11 is a side view of a primary molded product.

As shown in FIGS. 5, 11 and 15, the bend 22 is continuous with the upper end of the terminal body 21 and the front end of the wire-side connecting portion 23 and is bent substantially at a right angle to extend rearward from the upper end of the terminal body 21. Thus, side surfaces 22A of the bend 22 on both left and right sides extending in a bending direction have outer peripheral edges that are curved more gently than inner peripheral edges, as shown in FIGS. 15 and 17.

ds shown in FIGS. 15 to 17, the wire-side connecting portion 23 is a flat plate, and has flat side surfaces 27 extending in an extending direction in the wire-side connecting portion 23. The upper surface of the wire-side connecting portion 23 serves as a connection surface 28 to be bolted to a mating terminal. A bolt hole 29 penetrates the wire-side connecting portion 23 vertically in a plate thickness direction. The mating terminal is placed on the connection surface 28 of the wire-side connecting portion 23, and an unillustrated bolt is inserted into the bolt hole 29 to bolt the wire-side connecting portion 23 to the mating terminal.

The device-side connecting portion 24 is provided on the lower end part of the terminal body 21 while being somewhat offset forward from the terminal body 21 and can be bolted to the device-side terminal.

Figure 3:
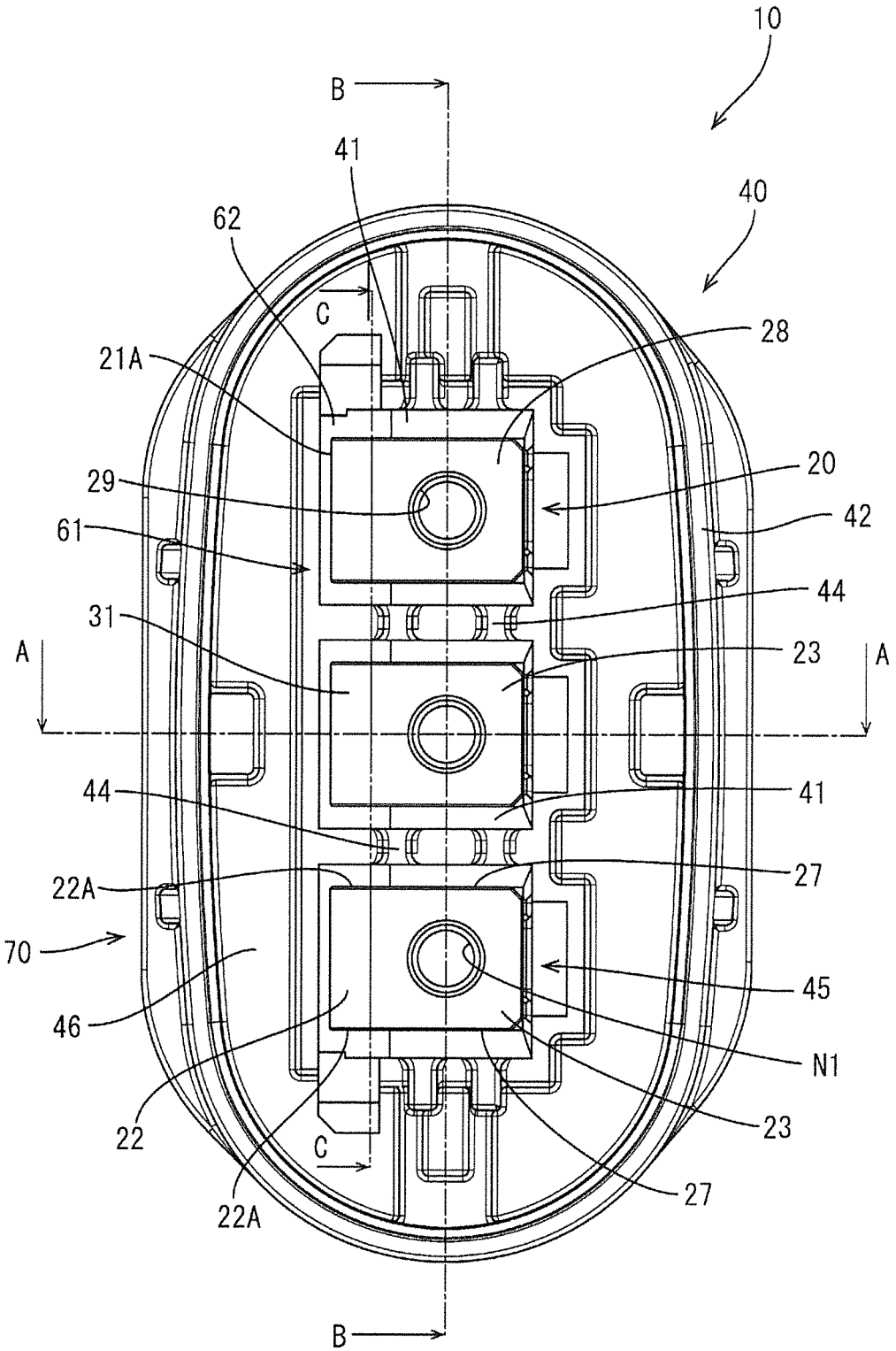
FIG. 3 is a plan view of the terminal block.
Figure 4:
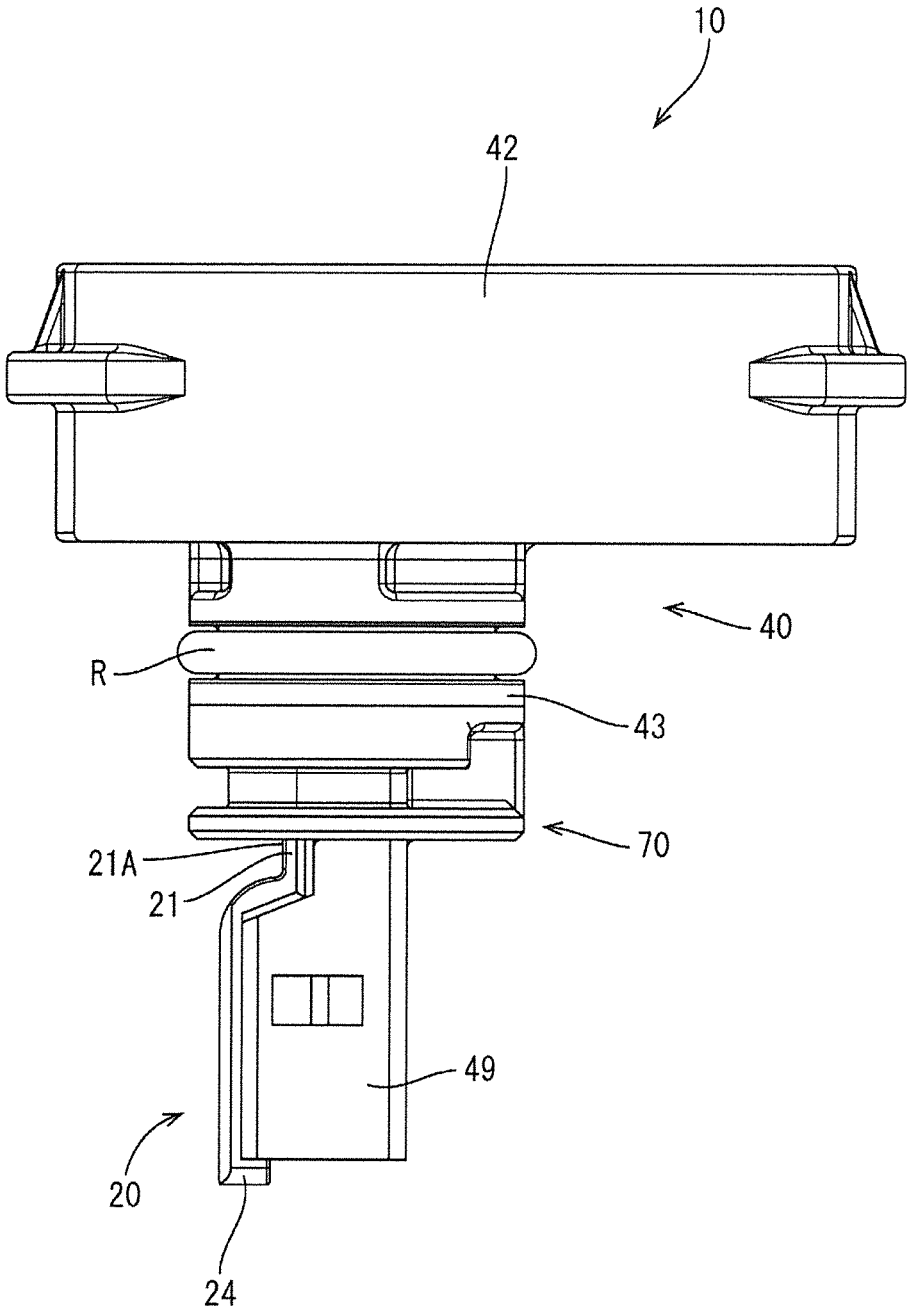
FIG. 4 is a side view of the terminal block.

As shown in FIGS. 1, 3 and 5, the housing 40 includes covers 41 that cover the upper end part of each terminal 20 from front, rear, left and right sides. A tubular portion 42 for surrounds the upper end parts of the terminals 20 and the covers 41 over the entire periphery, and a fitting 43 is to be fit into an unillustrated mounting hole provided in the case.

Each cover 41 is a block that is molded to cover a lower half of the wire-side connecting portion 23 except rear end parts 27A of the flat side surfaces 27 of the wire-side connecting portion 23 and an inner curved surface 30 of the bend 22, and to embed parts of the terminal body 21 near the upper end except upper end parts 25A of the flat side surfaces 25 in the terminal body 21 and an upper part of the front surface of the terminal body 21. Further, the respective covers 41 are coupled by rib-like couplings 44 provided between adjacent covers 41.

As shown in FIG. 5, a nut accommodating portion 45 is provided inside each covering 41 for accommodating a nut N. The nut N is a square nut having a vertically open fastening hole N1, and a thickness of the nut N is about twice the plate thickness of the terminal 20. In other words, the plate thickness of the terminal 20 is set to be about half the thickness of the nut N.

The nut accommodating portion 45 is open upward and rearward, and the nut N is accommodated in a press-fit state through a rear opening. An upper opening of the nut accommodating portion 45 is closed by the wire-side connecting portion 23. When the nut N is accommodated at a proper position in the nut accommodating portion 45, the lower surface of the wire-side connecting portion 23 and the upper surface of the nut N are vertically in contact and the bolt hole 29 of the wire-side connecting portion 23 and the fastening hole N1 of the nut N are coaxial, as shown in FIG. 5.

As shown in FIGS. 1 and 3, the tubular portion 42 has a bottomed tubular shape that is long in the lateral direction. The tubular portion 42 is open upward and has a bottom wall 46 in a lower end part. The wire-side connecting portions 23 of the terminals 20 face up through an upper opening of the tubular portion 42. The bottom wall 46 has an elliptical shape long in the lateral direction, and three covers 41 juxtaposed in the lateral direction are integral to the bottom wall 46 in a center of the bottom wall 46.

As shown in FIGS. 1, 2, 4 and 5, the fitting 43 extends down from the lower surface of the tubular portion 42, and a seal ring R is fit on the outer periphery of the fitting 43. Lower halves of the terminal bodies 21 of the three terminals 20 are embedded collectively inside the fitting 43, and the device-side connecting portions 24 of the terminals 20 project down from the lower surface of the fitting 43.

Laterally coupled device-side nut accommodating portions 49 are provided for each terminal to be continuous with a lower part of the fitting 43. The device-side couplings are provided behind the device-side connecting portions 24. The device-side nut accommodating portion 49 is open down, and a nut N is accommodated in a press-fit state into the device-side nut accommodating portion 49 through a lower end opening.

The terminal block 10 is formed by performing resin molding twice. Specifically, the terminal block 10 is formed as follows. First, primary molded products 61 each composed of the terminal 20 and a molded portion 62 are formed, and three primary molded products 61 are juxtaposed in the lateral direction to constitute a primary molded product group 60. Then, the primary molded product group 60 is set as a core in a mold, and a secondary molded portion 70 is formed by molding. Specifically, the housing 40 is formed by integrating the molded portions 62 of the primary molded products 61 and the secondary molded portion 70.

The primary molded products 61 and the secondary molded product 70 are described below.

The terminal 20 in the primary molded product 61 is formed by stamping and bending the thick metal plate by press working and includes the bend 22 formed by being bent.

When the bend 22 is formed by applying bending to the thick metal plate material in the terminal 20, the outer peripheral edges of the side surfaces 22A of the bend 22 are thinned laterally inward as an outer curved surface 31 of the bend 22 extends. Further, excess metal parts bulging outward due to the deflection of the inner curved surface 30 of the bend 22 are formed on inner peripheral edges of the side surfaces 22A of the bend 22. That is, the side surfaces 22A of the bend 22 become wider from an outer side toward an inner side.

Figure 18:
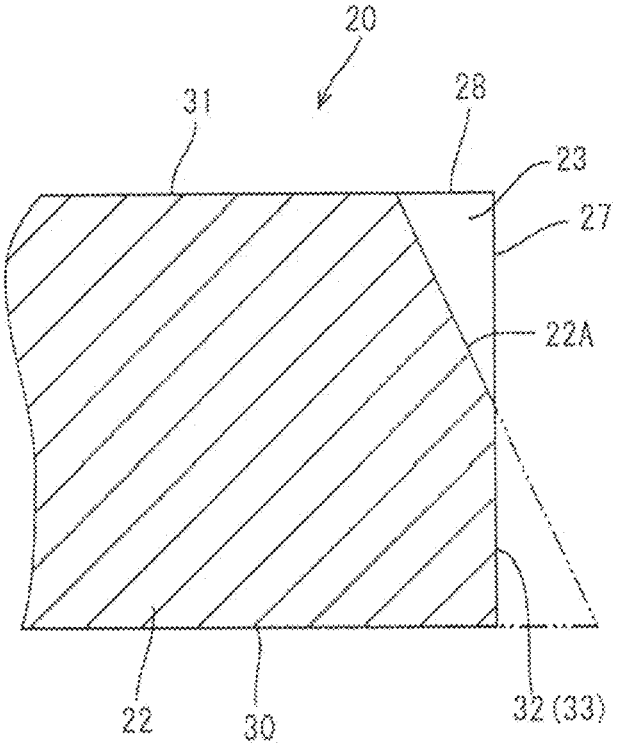
FIG. 18 is a sectional diagram of a bent portion.

Accordingly, by applying pressing or the like to flatten the excess metal parts formed on the side surfaces 22A of the bend, flat side surfaces 32 are formed on the inner peripheral edge parts of the side surfaces 22A of the bend 22, as shown in a diagram of FIG. 18. Further, the flat side surface 32 of the bend 22 is flush with the flat side surface 27 of the connecting portion 23 and with the flat side surface 25 of the terminal body 21, as shown in FIG. 15. Note that the other configuration of the terminal 20 is not described to avoid repeated description.

The molded portion 62 of the primary molded product 61 roughly constitutes the covering 41 in the housing 40 and is in the form of a rectangular block. Further, as shown in FIGS. 8, 11 and 12, the molded portion 62 includes a connecting portion cover 63 for embedding a lower part of the wire-side connecting portion 23, a bend cover 64 for embedding the inner curved surface 30 of the bend 22, a body cover 65 for embedding a part of the terminal body 21 near the upper end and a nut accommodating portion 66 integrally formed to be continuous with these three covers 63, 64 and 65.

As shown in FIGS. 10 to 13, the connecting portion cover 63 is formed to cover lower halves of the flat side surfaces 27 of the wire-side connecting portion 23 except rear end parts 27A of the flat side surfaces 27 from lateral sides and cover both lateral ends of the lower surface of the wire-side connecting portion 23 from below. Thus, the connecting portion cover 63 exposes the rear parts 27A of the flat side surfaces 27 of the wire-side connecting portion 23.

As shown in FIGS. 8 and 11 to 14, the bend cover 64 is continuous with a rear end part of the connecting portion cover 63 while covering both lateral side edge parts of the inner curved surface 30 of the bend 22 obliquely from a lower-rear side, and exposes both side surfaces 22A of the bend 22.

Figure 12:
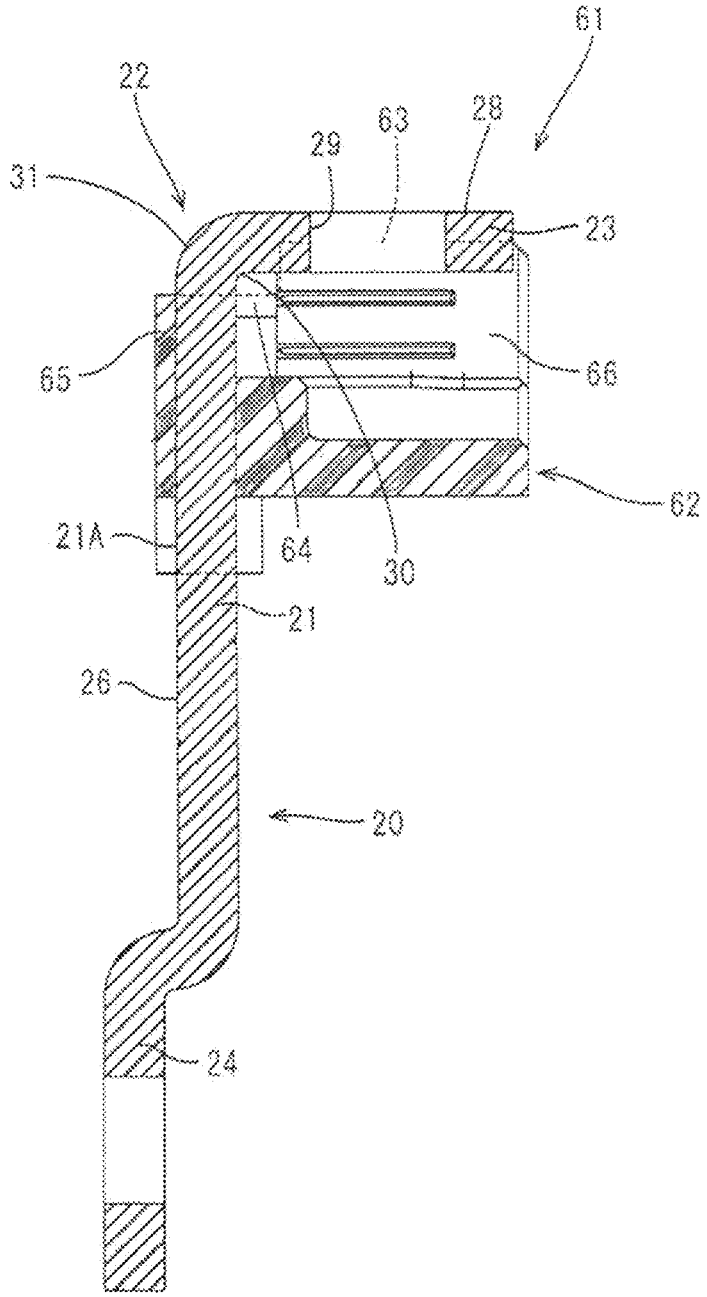
FIG. 12 is a section along D-D of FIG. 9.

As shown in FIGS. 10 to 12, the body cover 65 is continuous with a lower end of the bend cover 64 while covering a part of the terminal body 21 near the upper end except an upper end part of a front surface 21A of the terminal body 21 and the upper end parts 25A of the flat side surfaces 25 of the terminal body 21 over the entire periphery. Thus, the body cover 65 exposes the upper end parts 25A of the body-side flat surfaces 25.

Specifically, the left and right side surfaces 22A of the bend 22, the rear parts 27A of the flat side surfaces 27 adjacent to the bend 22 and the connecting portion cover 63 and the upper end parts 25A of the flat side surfaces 25 of the terminal body 21 adjacent to the bend 22 and the body cover 65 all are exposed from the molded portion 62, as shown in FIGS. 8, 11, 15 and 17, and the rear end part 27A of the flat side surface 27 of the wire-side connecting portion 23, the flat side surface 32 of the bend 22 and the upper end part 25A of the flat side surface 25 of the terminal body 21 serve as a resin cut-off surface 33 continuous and flush with the side surface of the terminal 20.

Figure 13:
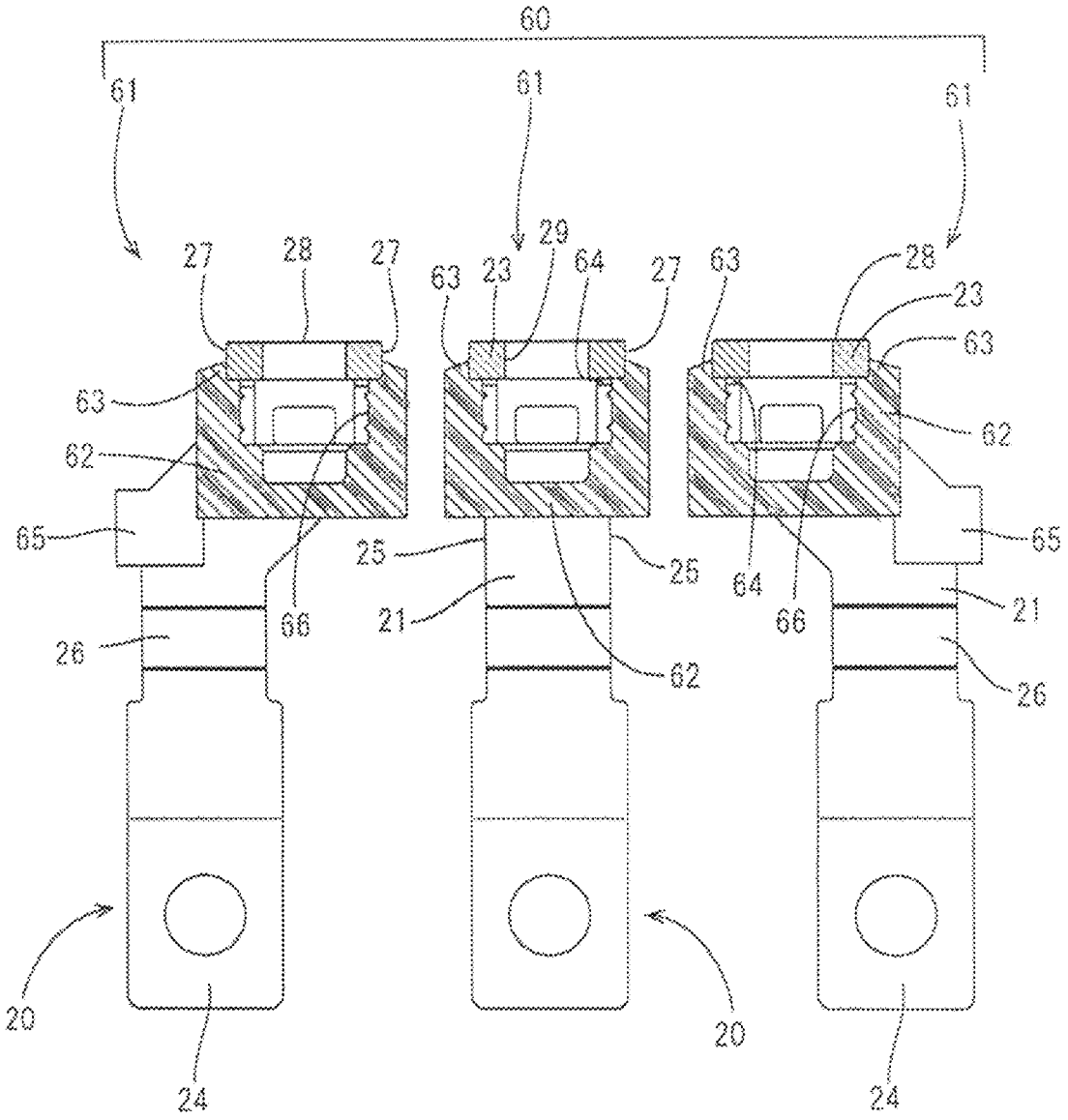
FIG. 13 is a section along E-E of FIG. 9.
Figure 14:
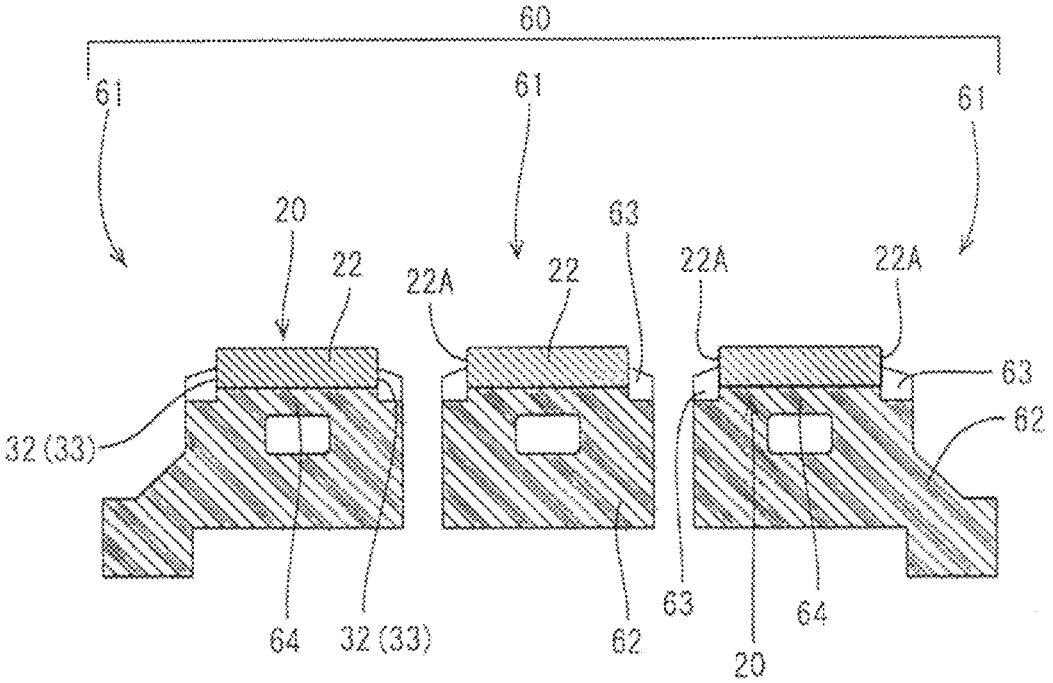
FIG. 14 is a section along F-F of FIG. 9.

The nut accommodating portion 66 constitutes the nut accommodating portion 45 of the housing 40 and is continuous with the lower end part of the connecting portion cover 63, the rear and lower end parts of the bend cover 64 and the rear end part of the body cover 65, as shown in FIGS. 12 and 13 and is formed into a substantially rectangular box shape in a side view, as shown in FIG. 11. Note that the structure of the nut accommodating portion 66 is the same as that of the nut accommodating portion 45 described above and is not described to avoid repeated description. Further, the nuts N are inserted into the nut accommodating portions 66 after the primary molded products 61 are completed, and the secondary molded product 70 is formed using the primary molded products 61 with the nuts N accommodated therein as cores.

The secondary molded product 70 roughly constitutes the tubular portion 42, the fitting 43 and the device-side nut accommodating portions 49 in the housing 40. The bottom wall 46 of the tubular portion 42 is molded to be continuous with the lower end parts of the molded portions 62 of the primary molded products 61 so that the primary molded products 61 and the secondary molded product 70 are integrally fixed to constitute the terminal block 60.

This embodiment is configured as described above. Next, a procedure of assembling the terminal block 10 is described and functions and effects of the terminal block 10 are described.

In assembling the terminal block 10, the primary molded products 61 are formed first.

The primary molded product 61 is formed as follows. First, the terminal 20 is formed by applying stamping and bending to the thick metal plate material by press working and is set in the mold (not shown).

When the terminal 20 is set in the mold, the terminal body 21 of the terminal 20 is pressed over the entire periphery by the mold at a position slightly above the sealant adhering portion 26, and the upper end parts 25A of the flat side surfaces 25 of the terminal body 21 and the upper end part of the front surface 21A of the terminal body 21 are pressed by the mold. Further, the rear end parts 27A of the flat side surfaces 27 of the wire-side connecting portion 23 and upper halves of the flat side surfaces 27 of the wire-side connecting portion 23 are pressed by the mold in the wire-side connecting portion 23 of the terminal 20 and the flat surfaces 32 of the side surfaces 22A on both lateral sides are pressed in the bend 22. Specifically, the resin cut-off surfaces 33 are pressed by the mold on the both side surfaces of the terminal 20.

If molding resin is injected into the mold in this state, the resin is cut off in parts where the terminal 20 and the mold are in contact. Thus, the molded portion 62 is formed to complete the primary molded product 61 in which the terminal 20 and the molded portion 62 are fixed integrally.

For example, if a terminal including a bend is formed by press-working a thick metal plate material, but flat surface portions are not formed on side surfaces of the bend, excess metal parts formed according to press working remain on the side surfaces of the bend. Then, in setting the terminal in a mold, the excess metal parts interfere with the mold, and the terminal cannot be set in the mold.

Even if the terminal can be set in the mold, clearances may be formed between the side surfaces of the bend and the mold when the side surfaces of the bends are pressed by the mold. If the clearances are formed, resin leaks through the clearances and adheres to an outer curved surface of the bend and further a connection surface of a wire-side connecting portion.

According to this embodiment, when the terminal 20 is set in the mold, the resin cut-off surfaces 33 are pressed by the mold on the side surfaces of the terminal 20. Thus, the molding resin for forming respective covers 63, 64 and 65 is reliably cut off at the resin cut-off surfaces 33 and the molded portion 62 is formed without the molding resin adhering to the connection surface 28 of the wire-side connecting portion 23 and the outer curved surface 31 of the bend 22.

The molded portion 62 is cooled and cured to complete the primary molded product 61 in which the terminal 20 and the molded portion 62 are fixed integrally.

Specifically, according to this embodiment, the flat surfaces 32 are provided on the inner peripheral edges of the side surfaces 22A of the distorted bend 22 by press working. Thus, the molding resin can be cut off between the mold and each of: the flat surfaces 32; the upper parts 25A of the flat side surfaces 25 of the terminal body 21; and the rear end parts 27A of the flat side surfaces 27 of the wire-side connecting portion 23, i.e. at the resin cut-off surfaces 33. Thus, the molding resin cannot adhere to the outer curved surface 31 of the bend 22 and further to the connection surface 28 of the wire-side connecting portion 23 through the side surfaces 22A of the bend 22. In this way, connection reliability between the wire-side connecting portion 23 and the mating terminal is improved.

After the primary molded products 61 are completed in this way, three primary molded products 61 are juxtaposed in the lateral direction to constitute the primary molded product group 60 and the secondary molded product 70 is formed using this primary molded product group 60 as a core, thereby completing the terminal block 10.

In the case of cutting off the resin at the side surfaces 22A of the bend 22, it also is considered to cut off the molding resin not only at the inner peripheral edge parts of the side surfaces of the bend, but also at the flat surfaces formed on the entire side surfaces of the bend or on the outer peripheral edge parts of the side surfaces of the bend.

However, if a thick metal plate material is bent, the outer peripheral edges on the side surfaces of the bend are thinned laterally inward as the outer curved surface of the bend extends, and excess metal parts bulging outward are formed on the inner peripheral edges of the side surfaces of the bend due to the deflection of the inner curved surface of the bend.

Accordingly, if it is tried to control a width of the bend on the entire side surfaces of the bend or on the outer peripheral edges of the side surfaces, the width of the bend of each terminal varies. In the case of setting such a terminal in a mold, the arrangement of the mold needs to be adjusted for each terminal and the mold needs to be brought into contact with the side surfaces of the bend. Thus, the work efficiency of a terminal block assembling operation is reduced.

However, according to this embodiment, the excess metal parts bulging on the side surfaces 22A of the bend 22 are flattened to form the flat side surfaces 32 flush with the flat side surfaces 27 of the wire-side connecting portion 23 and the flat side surfaces 25 of the terminal body 21. That is, since a lateral width of the bend 22 is aligned with those of the wire-side connecting portion 23 and the terminal body 21, the primary molded product 61 can be set in the mold without adjusting the arrangement of the mold for each terminal 20. In this way, work efficiency is improved in the assembling operation of the terminal block 10.

As described above, according to this embodiment, the bend 22 is bent substantially at a right angle and excess metal parts are formed on the inner peripheral edges of the side surfaces 22A of the bend 22 in forming the primary molded product 61. However, the flat surfaces 32 are formed on the side surfaces 22A of the bend 22 by press working, and the resin cut-off surfaces 33 are provided on the side surfaces of the terminal 20. Thus, the molding resin can be cut off between the resin cut-off surfaces 33 and the mold so that the molding resin cannot adhere to the outer curved surface 31 of the bend 22 and the connection surface 28 of the wire-side connecting portion 23 through the side surfaces 22A of the bend 22. Specifically, it is possible to prevent a reduction of connection reliability between the wire-side connecting portion 23 and the mating terminal due to the adhesion of the resin to the connection surface 28 of the wire-side connecting portion 23.

Specifically, according to this embodiment, the primary molded product 61 can be set in the mold while preventing resin leakage in the primary molded product 61 merely by applying flattening only to the inner peripheral edge parts on the side surfaces of the bend 22. This is very effective if a press-worked part is distorted due to an increase in the thickness of a metal plate material.

Further, according to this embodiment, the flat surfaces 32 are formed on the inner peripheral edge parts of the side surfaces 22A of the bend 22 and the lateral width of the bent portion 22 is aligned with those of the wire-side connecting portion 23 and the terminal body 21. Thus, a dimensional control of the width of the entire terminal 20 can be facilitated as compared to the case where the width of the bend is set on the basis of the entire side surfaces of the bend or the outer peripheral edges of the side surfaces of the bend. In this way, the primary molded product 61 can be set in the mold without adjusting the arrangement of the mold for each terminal 20 and work efficiency is improved during the assembling operation of the terminal 10.

The invention is not limited to the above described and illustrated embodiment. For example, the following modes also are included.

In the above embodiment, the terminal body 10 in which the flat surfaces 32 are formed on the bends 22 of the terminals 20 is shown as an example. However, without limitation to this, the invention disclosed in this specification may be applied in forming a resin molded product by insert molding with a bracket made of metal, a metal plate or the like placed as an insert in a resin portion made of synthetic resin.

In the above embodiment, the flat surfaces 32 are formed on the bend 22 bent substantially at a right angle. However, without limitation to this, flat surfaces may be formed on a bend bent at an obtuse or acute angle.

LIST OF REFERENCE SIGNS

10: terminal block (resin molded product)
20: terminal (metal member)
21: terminal body (flat plate)
22: bend
23: wire-side connecting portion (flat plate portion, connecting portion)
25: flat side surface
27: flat side surface
30: inner curved surface (inner surface of bend)
32: flat surface
40: housing (resin portion)
62: molded portion

The invention claimed is:

1. A resin molded product in which a plate-like metal member and a resin portion made of synthetic resin are integrally fixed, comprising:

a bend provided by bending the metal member;

two flat plates extending integrally from both ends of the bend in the metal member:

a molded portion provided in the resin portion to embed parts of the two flat plates together with an inner surface of the bend;

each of the flat plates having opposite flat side surfaces extending along an extending direction of the respective flat plate, a part of each of the side surfaces of each of the flat plates being disposed adjacent to the molded portion and being exposed from the molded portion;

the bend having opposite side surfaces, areas of each of the side surfaces of the bend that are adjacent an inner peripheral edge of the bend extending along a bending direction of the bend defining flat bend surfaces that are continuous and flush with the flat side surfaces of the flat plates, the flat bend surfaces of the bend being disposed adjacent to the molded portion and exposed from the molded portion; and areas of the molded portion that embed the inner surface of the bend having flat side surfaces that are continuous and flush with the flat side surfaces of the flat plates, the flat bend surfaces of the bend.

2. The resin molded product of claim 1, wherein each of the flat plates constitutes a connecting portion connectable to a mating conductor.

* * * * *